United States Patent [19]

Simonsson

[11] Patent Number: 4,831,686

[45] Date of Patent: May 23, 1989

[54] VACUUM CLEANING TOOL

[75] Inventor: Sven B. Simonsson, Stockholm, Sweden

[73] Assignee: Aktiebologet Electrolux, Stockholm, Sweden

[21] Appl. No.: 117,814

[22] Filed: Nov. 6, 1987

[30] Foreign Application Priority Data

Dec. 2, 1986 [SE] Sweden ..... 8605164

[51] Int. Cl.[4] ..... A47L 9/06

[52] U.S. Cl. ..... 15/373

[58] Field of Search ..... 15/373, 371, 368

[56] References Cited

U.S. PATENT DOCUMENTS

| | | | |
|---|---|---|---|
| 2,597,808 | 5/1952 | McQuilkin | 15/373 |
| 3,952,363 | 4/1976 | Lindman | 15/373 |
| 4,073,031 | 2/1978 | Schwartz | 15/373 |
| 4,351,083 | 9/1982 | Simonsson | 15/373 |
| 4,360,948 | 11/1982 | Simonsson | 15/373 |

FOREIGN PATENT DOCUMENTS

| | | | |
|---|---|---|---|
| 77554 | 5/1954 | Denmark | 15/373 |
| 936881 | 7/1980 | U.S.S.R. | 15/373 |
| 2026310 | 2/1980 | United Kingdom | 15/373 |

*Primary Examiner*—Chris K. Moore
*Attorney, Agent, or Firm*—Alfred E. Miller

[57] ABSTRACT

A combined vacuum cleaning tool comprises two mutually movable parts, such as a flat surface nozzle (12) and a brush nozzle (10) which are alternatively adjustable between working and non-working positions, the flat surface nozzle being resiliently actuated to occupy its working position. An adjusting mechanism comprises control means (15) rotatably supported by the brush nozzle and cooperating with a means (18, 21) attached to the flat surface nozzle in order to move the brush nozzle into engagement with a working surface during a first phase and remove the flat surface nozzle from the working surface during a second phase. The adjusting mechanism comprises a contact surface (18*a*, 15*f*) having a curvature generally corresponding to the path of movement of the brush nozzle during said first phase, whereby during at least the major portion of this phase the adjustment takes place generally without rotational movement of the control means (15), and during said second phase said flat surface nozzle being removed from said working surface as a result of the rotational movement of said control means.

3 Claims, 3 Drawing Sheets

VACUUM CLEANING TOOL

The present invention relates to a combined vacuum cleaning tool comprising two mutually movable nozzle portions, such as a flat surface nozzle and a brush nozzle which are alternately adjustable between a working position engaging a working surface and a non-working position spaced from the working surface, said flat surface nozzle being actuated by a resilient force to occupy its working position, and an adjusting mechanism comprising a control means rotatably supported by the brush nozzle and actuatable by an operating force to cooperate with a means connected to the flat surface nozzle in order to move the brush nozzle into engagement with the working surface during a first phase, and remove the flat surface nozzle from the working surface during a second phase.

It is a disadvantage of known vacuum cleaning tools of this kind that the operating force required for the adjustment is relatively great which is due to the fact that the operating force, as a rule, to a certain extent counteracts the adjusting movement. Another disadvantage is that the distance of movement of the control means is longer than would be desirable.

Because of these disadvantages the use of the known vacuum cleaning tools is inconvenient.

The object of the present invention is to provide a vacuum cleaning tool by which the above-mentioned disadvantages have been eliminated so that the adjustment can be made by a small force and with a short control movement. This has been obtained by means of a vacuum cleaning tool of the kind mentioned in the introduction, which according to the invention is generally characterized in that the adjusting mechanism comprises a contact surface having a curvature generally corresponding to the path of movement of the brush nozzle during said first phase, whereby during at least the major portion of this phase the adjustment takes place generally without rotational movement of the control means, and during said second phase said flat surface nozzle being removed from said working surface as a result of the actuation of the rotational movement of said control means.

Figure 1:
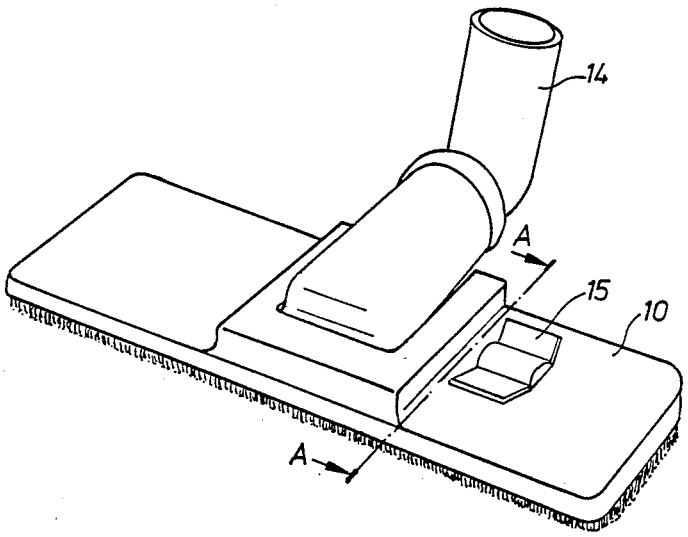
Figure 2:
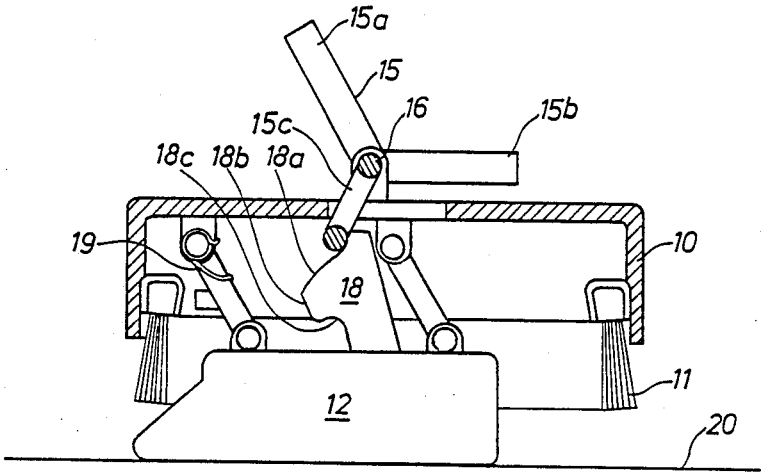
Figure 3:
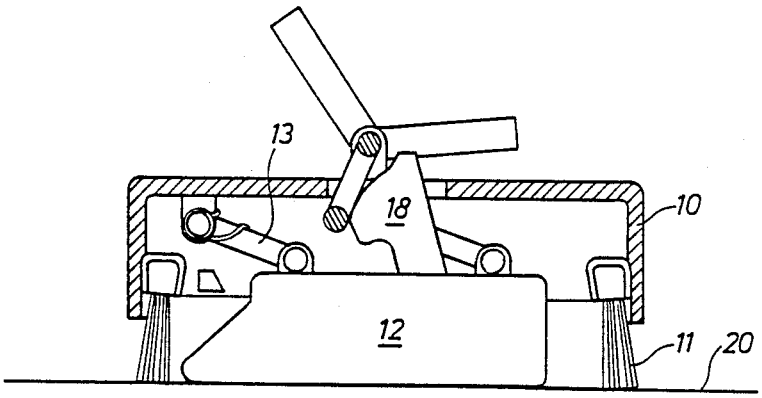
Figure 4:
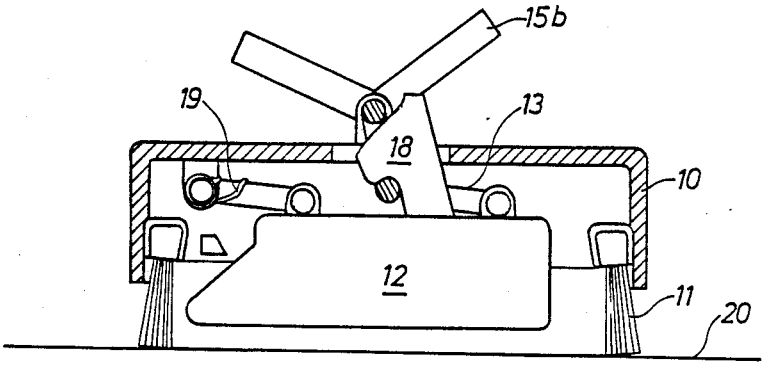
Figure 5:
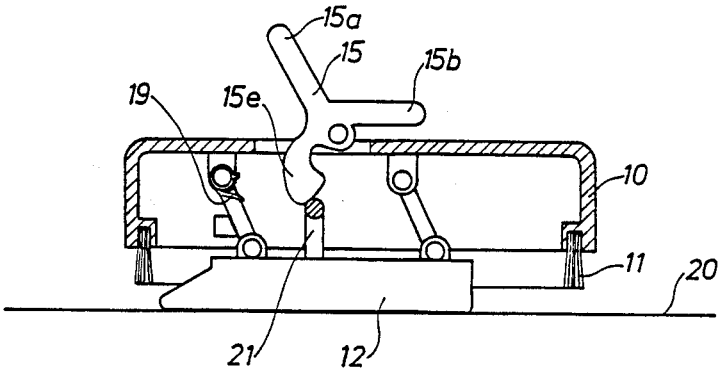
Figure 6:
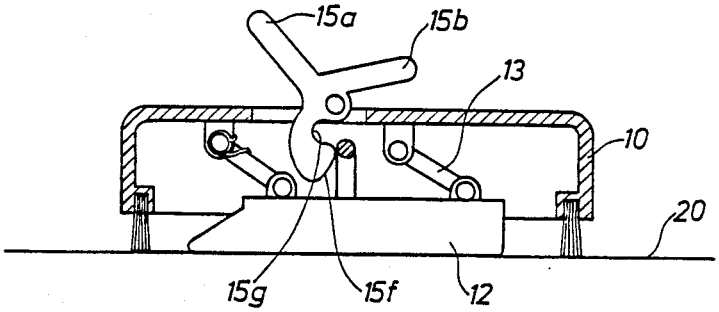
Figure 7:
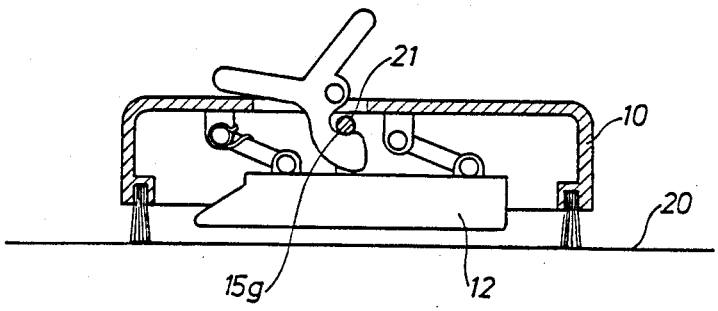

The invention will be described in more detail below with reference to the accompanying drawings, on which FIG. 1 illustrates a perspective view of the vacuum cleaning tool according to the invention, FIGS. 2–4 are diagrammatic cross-sections taken along line A—A in FIG. 1 and illustrating a first embodiment of the invention in three different positions, and FIGS. 5–7 are corresponding views of a second embodiment.

The vacuum cleaning tool shown in FIG. 1 comprises a brush nozzle 10 having a control means 15, and a tube socket 14 connected to a flat surface nozzle (not shown).

The embodiment shown diagrammatically in FIGS. 2–4 comprises a brush nozzle 10 with an annular brush 11. A flat surface nozzle 12 is movably connected to the brush nozzle by means of a parallelogram mechanism 13. The brush nozzle 10 is provided with a control means 15 which is pivotably supported on a shaft 16 and comprises two outer levers 15*a*, 15*b* and a loop-like lever 15*c* extending downwards. The two levers 15*a*, 15*b* are mutually inclined and in practice function as pedals, whilst the lever 15*c* cooperates with a means 18 attached to the flat surface nozzle 12. The means 18 comprises a first, convex contact surface 18*a*, a second contact surface 18*b* generally perpendicular to the surface 18*a*, and a third, concave contact surface 18.

In the position shown in FIG. 1, the flat surface nozzle 12 engages a floor 20 to be cleaned, the brush nozzle 10 with the brush 11 being in a raised position spaced above the floor. The nozzle parts are held in this position by means of a spring 19.

For the adjustment a downward force is applied to the lever 15*a*, and in a first phase the brush nozzle moves downwards against the force of the spring 19 until the brush 11 engages the floor (FIG. 3). In this phase, the lower end of the lever 15*c* slidingly engages the convex surface 18*a* of the means 18. The surface 18*a* has a curvature generally corresponding to the path of movement of the brush nozzle 10 and therefore, the angular position of the control means 15 is not changed to any greater extent during this phase.

From the position in FIG. 3, in which the brush 11 engages the floor, the flat surface nozzle 12 is raised to the position of FIG. 4 in that the lower end of the lever 15*c* engages firstly the surface 18*b* and then the concave surface 18c, whereby the flat surface nozzle is latched in the raised position as shown in FIG. 4. Since the control means 15 is supported by the brush nozzle 10 the vertical movement of the flat surface nozzle 12 during this phase is not counteracted by the downward force on the lever 15*a*. This force is instead transferred via the brush 11 to the floor 20. The adjustment is therefore made easily and by a small operating force. A reason contributing to this is also that generally the entire pivoting movement of the control means 15 remains unexploited after the first phase and can therefore by utilized during the second phase, when the flat surface nozzle is raised from the floor.

For the adjustment from the position in FIG. 4, the lever 15*b* is depressed whereby the lever 15*c* is released from its engagement with the concave surface 18c and the adjustment takes place automatically by means of the spring 19 until the tool is again in the position according to FIG. 2.

The embodiment according to FIGS. 5–7 is generally constructed in the same way as has been described above and corresponding details are provided with the same reference numerals. The control means 15 is in this case provided with a specially shaped lower lever 15*e* cooperating with a loop 21 attached to the flat surface nozzle 12.

The function of this embodiment is similar to what has been described above with reference to FIGS. 2–4. When the lever 15*a* is depressed the brush nozzle 10 is at first displaced against the action of the spring 19 to the position according to FIG. 6. During this phase, the top portion of the loop 21 travels along a curved surface 15*f* of the lever 15*e*. The radius of curvature of the surface 15*f* generally corresponds to the path of movement of the brush nozzle which means that the angular position of the control means 15 is not changed appreciably, at least not during the major portion of this phase. When the lever 15 is depressed further, the flat surface nozzle 12 is raised from the floor and is latched in the position according to FIG. 7 in that the loop 21 engages a concave surface 15*g* of the lever 15*e*.

The re-adjustment is performed in the manner described above by depressing the lever 15*b* to release the loop 21, and hence the spring 19 provides the return to the position according to FIG. 5.

I claim:

1. In a vacuum cleaning tool having a housing provided with an aperture in the top surface thereof and including a flat surface nozzle and a brush nozzle therein both of which are mutually movable and which are alternately adjustable between a working position engaging a working surface and a non-working position spaced from said working surface, the improvement comprising: resilient means connecting said brush nozzle to said flat surface nozzle and for normally biasing said flat surface nozzle to said working position, a pivotable external control means having a part projecting through said housing aperture and being operatively connected to said flat surface nozzle and rotatably supported by said brush nozzle, a member being mounted on said flat surface nozzle and having a curved contact surface, the projecting part of said control means engaging said curved contact surface, and whereby upon initial movement of said control means along said contact surface said brush nozzle is moved to a working position, and upon further movement of said projecting part along said contact surface the flat surface nozzle is moved away from the working surface.

2. A vacuum cleaning tool as claimed in claim 1 wherein said control means is provided with a lever cooperating with said contact surface during said adjustment.

3. A vacuum cleaning tool as claimed in claim 1 further comprising a parallelogram mechanism for pivotally interconnecting said nozzle flat surface nozzle and said brush nozzle.

* * * * *